US006618892B2

(12) United States Patent
Schmitt

(10) Patent No.: US 6,618,892 B2
(45) Date of Patent: Sep. 16, 2003

(54) SOCKET LATCH DRUM RELEASE FOR A DRAIN CLEANING MACHINE

(75) Inventor: Randall Paul Schmitt, Clinton Township, MI (US)

(73) Assignee: Masco Corporation, Taylor, MI (US)

( * ) Notice: Subject to any disclaimer, the term of this patent is extended or adjusted under 35 U.S.C. 154(b) by 163 days.

(21) Appl. No.: 09/965,085

(22) Filed: Sep. 27, 2001

(65) Prior Publication Data

US 2003/0056308 A1 Mar. 27, 2003

(51) Int. Cl.[7] ..... B08B 9/02

(52) U.S. Cl. ..... 15/104.33; 242/387; 242/404; 242/593; 242/597.3; 403/322.2

(58) Field of Search ..... 15/104.33; 403/321, 403/322.1, 322.2; 242/570, 593, 597.3, 387, 404

(56) References Cited

U.S. PATENT DOCUMENTS

| | | | | | |
|---|---|---|---|---|---|
| 2,588,901 | A | * | 3/1952 | Weikart | 403/322.2 X |
| 3,468,169 | A | * | 9/1969 | Welch | 403/321 X |
| 3,608,122 | A | * | 9/1971 | Ratliff | 15/104.33 |
| 3,958,293 | A | * | 5/1976 | Irwin | 15/104.33 |
| 4,716,613 | A | * | 1/1988 | Irwin | 15/104.33 |
| 4,914,775 | A | * | 4/1990 | Kirk | 15/104.33 |
| 4,916,772 | A | * | 4/1990 | Russell et al. | 15/104.33 |
| 5,031,276 | A | | 7/1991 | Babb et al. | 15/104.33 |
| 5,458,431 | A | * | 10/1995 | Ferreol-Ragotin | 403/322 |
| 5,507,062 | A | | 4/1996 | Salecker | 15/104.33 |
| 5,618,123 | A | | 4/1997 | Pulse | 15/104.33 X |
| 5,640,736 | A | | 6/1997 | Salecker | 15/104.33 |
| 6,006,632 | A | * | 12/1999 | Hsieh | 403/322 |
| 6,243,905 | B1 | | 6/2001 | Rutkowski | 15/104.33 |

* cited by examiner

*Primary Examiner*—Mark Spisich
(74) *Attorney, Agent, or Firm*—Carlson, Gaskey & Olds

(57) ABSTRACT

A socket latch drum release assembly includes a shaft release coupling which telescopically engages a rotary drum shaft to selectively lock and unlock a rotary drum of a drain cleaning machine without the necessity of tools. The shaft release coupling includes a polygonal shaped distal end which corresponds with a polygonal opening in the removable drum shaft. At least one of the plurality of faces which form the polygonal shaped distal end includes a retractable engagement member which corresponds to a recess located in each face of the polygonal opening. The drum shaft is directed into the sleeve from one side and the shaft release coupling is engaged with the shaft on the opposite side of the sleeve. Engagement between a radially extending flange of the shaft release coupling and the end of the shaft rotatably locks the rotary drum shaft into the sleeve.

18 Claims, 4 Drawing Sheets

SOCKET LATCH DRUM RELEASE FOR A DRAIN CLEANING MACHINE

BACKGROUND OF THE INVENTION

The present invention relates to a drain cleaning machine, and more particularly to a release assembly for removing the rotatable drum from the machine without tools.

Conventional drum type drain cleaning machines typically include a frame structure supporting a rotatable snake drum and a drive motor arrangement for rotating the drum. The frame structure also supports a snake feeding arrangement by which the snake or cable is axially displaced relative to the rotating drum during use of the machine. The snake coiled within the rotatable drum is displaced by the feeding arrangement and inserted into a pipe or drain to be cleaned. Rotation of the drum rotates the snake to achieve such cleaning.

The rotatable drum in known drain cleaning machines may typically be removed from the support frame and drive arrangement to facilitate replacement of the drum with one containing a snake having a different diameter and to make the separate components more mobile. Disadvantageously, conventional removable drums require tools to disassemble the rotatable drum from the support frame. This, of course, requires access to the proper tools and is also somewhat time consuming for the operator. Other known disassembly arrangements require a groove cut in a shaft which mounts the rotatable drum. The groove is located between the rotatable drum and the support frame to receive a spring-loaded pin which rides within the groove. The spring-loaded pin is retracted to disassemble the rotatable drum from the support frame. By its location, the groove reduces the strength of the shaft in a weight bearing segment. Friction between the groove and the single pin may also eventually require the repair or replacement of the disassembly arrangement. Further, the pin must be manually retracted to both install and remove the rotatable drum.

Accordingly, it is desirable to provide a rotatable drum release assembly which provides an effective release without the necessity of tools and which locates shaft grooves in a position to minimize their load bearing effect on the shaft.

SUMMARY OF THE INVENTION

The drum release assembly according to the present invention provides a shaft release coupling which telescopically engages a rotary drum shaft to lock and unlock a rotary drum to a drain cleaning machine. No shaft grooves are located in the shaft. Localized weakening of the shaft is thereby prevented.

The shaft release coupling includes a polygonal shaped distal end which corresponds with a polygonal opening in the removable drum shaft. At least one of the plurality of faces which form the polygonal shaped distal end includes a retractable engagement member. The retractable engagement member corresponds to a recess located in each face of the polygonal opening. By pressing on a release to overcome the bias of a biasing member, the retractable engagement member retracts into the shaft release coupling.

A removable thrust bushing is preferably mounted about the shaft release coupling between a radially extending flange and the end of the shaft receiving sleeve to reduce friction therebetween. The thrust bearing absorbs thrust produced as the snake is extended from the drum by the feed assembly. Longevity of the shaft release coupling is thereby improved.

To mount the removable drum, the drum shaft is located into one end of the sleeve. Once the shaft is accessible on the opposite side of the sleeve, the release is pressed inwardly and the polygonal shaped distal end is located into the polygonal opening. Once the retractable engagement member reaches the recess in the polygonal opening face, the biasing member drives the retractable engagement member into the recess. The drum is thereby rotatably locked in place.

To remove the drum, the release is pressed inwardly and the shaft release coupling is removed from the shaft. The shaft may then be slid out of the sleeve to remove the drum.

The present invention therefore provides a rotatable drum release assembly which provides an effective release without the necessity of tools and which eliminates shaft grooves and their reduced load bearing effect on the shaft. The present invention further provides a rotatable drum release assembly that has superior thrust capacity and a readily replaceable thrust washer.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
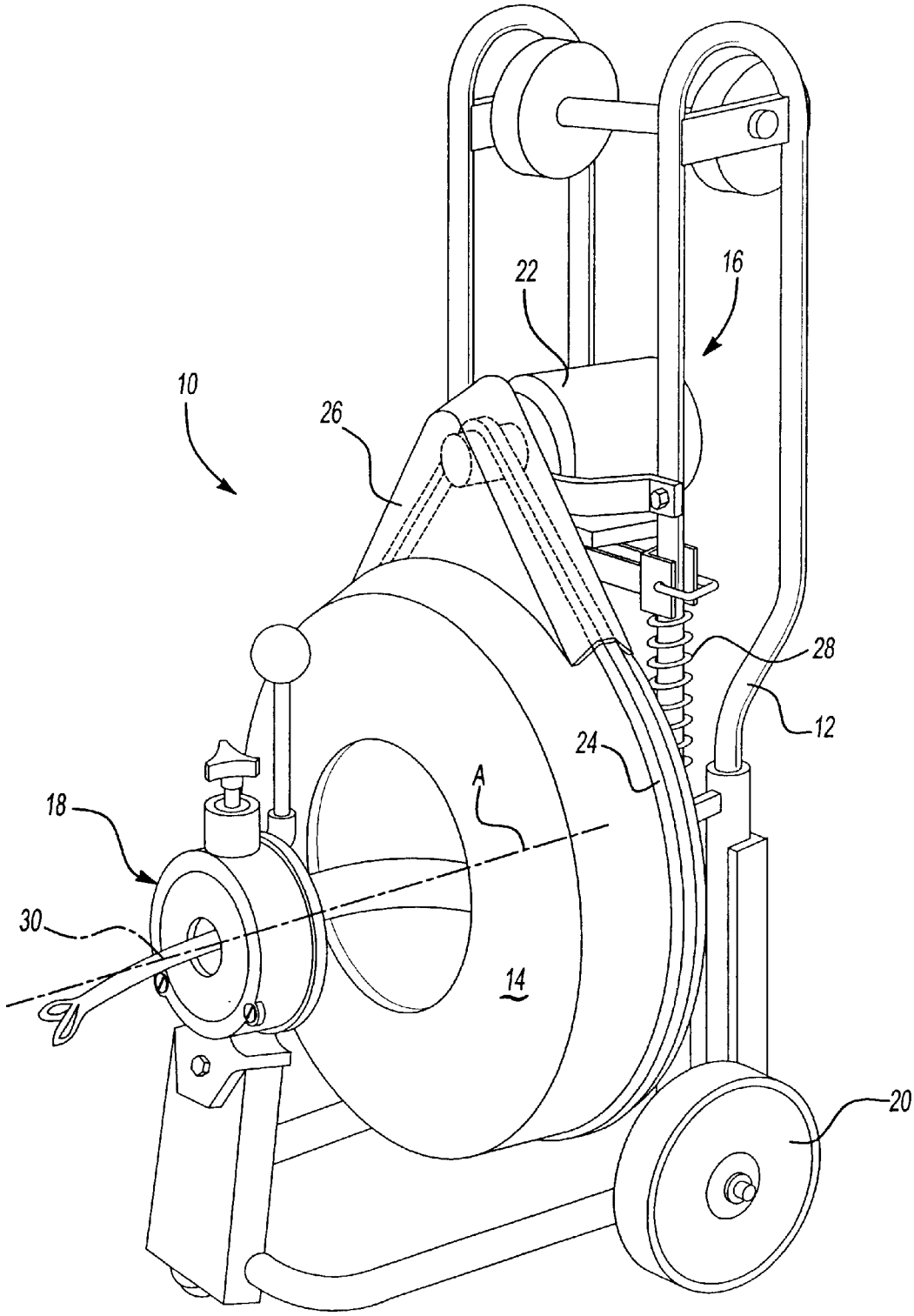
FIG. 1 is a general perspective view of a drain cleaning machine having a removable rotatable drum according to the present invention.

FIG. 1 illustrates a general perspective view of a portable drain cleaning machine 10 including a wheeled support frame assembly 12 which supports a rotatable snake drum 14, a drum drive assembly 16, and a snake feeding mechanism 18. Support frame assembly 12 is provided with at least one pair of wheels 20 such that the machine 10 is supported for rolling movement from one location to another.

The drum drive assembly 16 preferably includes an electric motor 22 which drives a drive belt 24. A removable cover 26 provides protection for the engagement between the belt 24 and motor 22. The motor 22 is mounted upon a biasing arrangement 28 which minimizes slack in the drive belt 24 and compensates for components which may be out of alignment while allowing removal of the belt 24.

The drum 14 contains a flexible plumbers snake 30 which extends outwardly through the feed assembly 18. The feed assembly 18 displaces the snake 30 inwardly and outwardly relative to the drum 14 during operation of the machine 10. The drive belt 24 extends from the motor 22 and about the perimeter of the drum 14. It should be understood that although the belt is illustrated about the perimeter of the drum in the disclosed embodiment, other drive arrangements will also benefit from the present invention. Rotation of the drive belt 24 rotates the drum 14 about an axis of rotation A.

Figure 2:
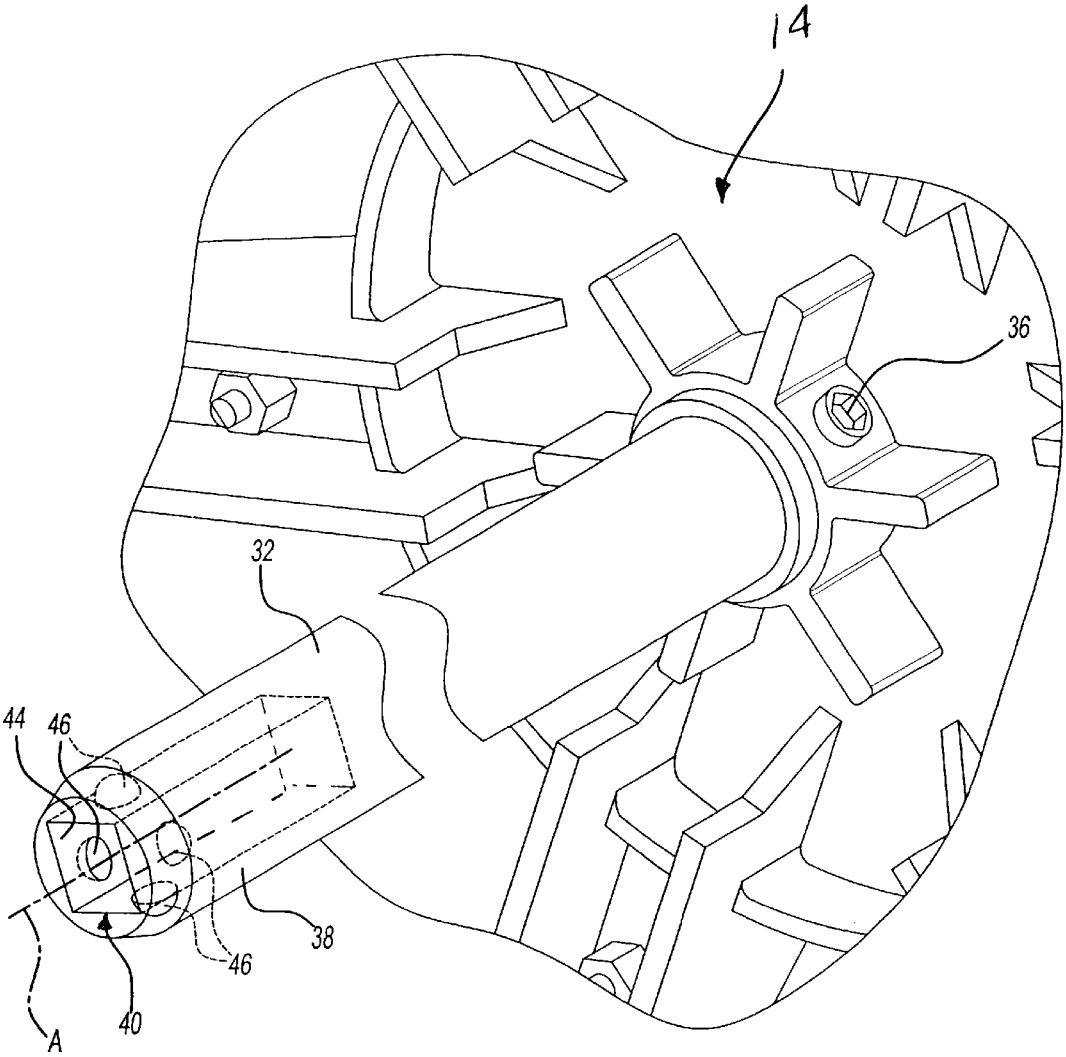
FIG. 2 is a rear perspective view of a removable rotatable drum.

Referring to FIG. 2, a rear view of the drum 14 illustrates a drum shaft 32 extending therefrom. The drum shaft 32 is mounted to the drum 14 by at least one fastener 36 such as a set screw of the like which engages a flat (not shown) on the shaft 32. The drum shaft 32 defines the axis of rotation A. The shaft includes a substantially flat distal end 38 having a polygonal opening 40 defined along the axis of rotation A. Preferably, the shaft includes no grooves or the like that may decrease the shaft strength. A smaller diameter and lighter shaft will thereby benefit from the present invention.

The polygonal opening 40 is preferably a square-shaped opening to telescopically receive a shaft release coupling 42 (FIG. 3) as will be further describe below. The polygonal opening 40 includes a plurality of faces 44. Each face 44 includes a recess 46, preferably a hemispherical recess.

Figure 3:
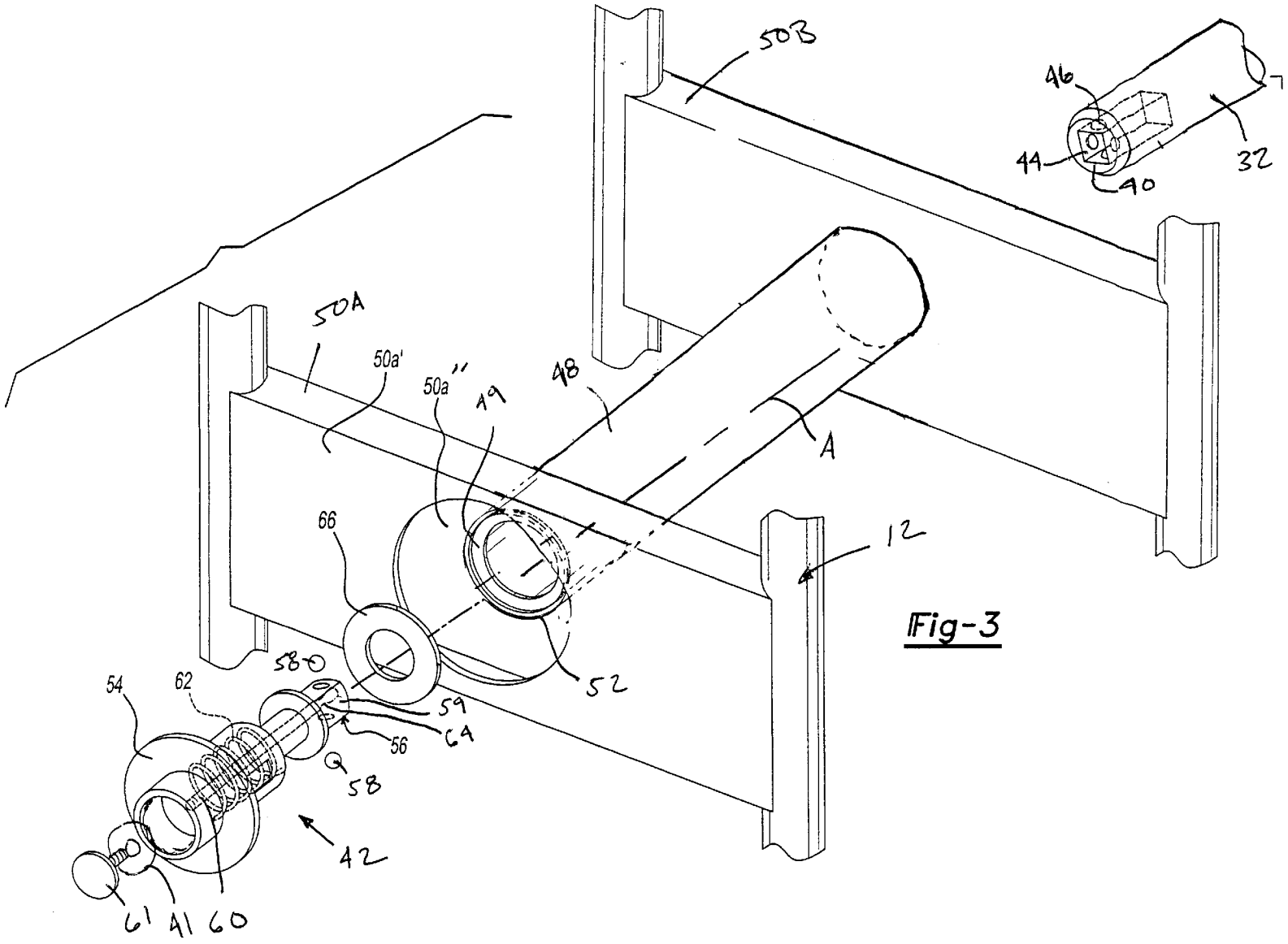
FIG. 3 is an expanded rear perspective view of a drain cleaning machine.

Referring to FIG. 3, the drum shaft 32 is rotatably and removably mounted in a sleeve 48 which is fixedly mounted to the support frame assembly 12. The sleeve 48 preferably contains one or more bushings or bearings 49 upon which the shaft 32 rotates. That is, the shaft 32 contacts the bearings and not the inner diameter of the sleeve 48. The sleeve 48 is mounted in a perpendicular relationship through a first and second cross brace assembly 50*a*, 50*b* of the frame assembly 12. The cross brace assembly 50 forms a substantially rigid box arrangement in cooperation with the frame assembly 12.

One cross brace 50A includes an opening 52 through one wall 50A' to receive the shaft release coupling 42 therethrough. Another wall 50A" of the cross brace 50A is flush with an end of the sleeve 48. The end of the sleeve 48 and wall 50A" form an engagement surface for a radially extending flange 54 of the shaft release coupling 42. The shaft release coupling 42 is recessed within the protected confines of the cross brace 50A. The cross brace 50A thereby protects the rotating shaft release coupling 42.

The radially extending flange 54 extends for a diameter greater than that of the sleeve 48. The shaft release coupling 42 rotates with the shaft 32 and the radially extending flange 54 resists the axial thrust along axis A. Axial thrust is generated when the drum 14 is rotated and the snake 30 is being extended therefrom.

The shaft release coupling 42 includes a polygonal shaped distal end 56 which corresponds with the polygonal opening 40. At least one of the plurality of faces 59 which form the polygonal shaped distal end 56 includes a retractable engagement member 58. The retractable engagement member 58 corresponds to the recesses 46 located in each face 44 of the polygonal opening 40.

Figure 4A:
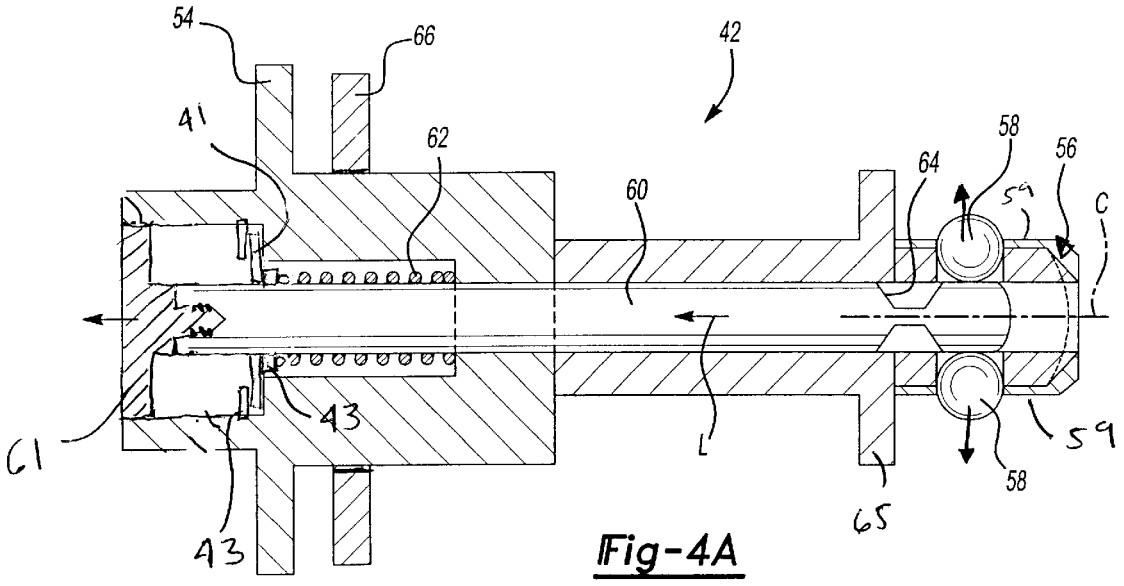
FIG. 4A is an expanded partial phantom view of a shaft release coupling as illustrated in FIG. 3 in a locked condition.

Preferably, a release 60 extends along a coupling axis C defined within the hollow shaft release coupling 42. The release 60 is a shaft-like member which is biased by a biasing member 62 toward (FIG. 4A; illustrated schematically by arrow L) the radially extending flange 54. Preferably, cam surfaces 64 formed in the release 60 engage the engagement member 58 to lock the engagement member in an extended position to project from the face 59. By pressing on the release 60 to overcome the bias of the biasing member 62, the retractable engagement member 58 is allowed to retract (FIG. 4B) into the shaft release coupling 42.

A removable thrust bushing 66 is preferably mounted about the shaft release coupling 42. Bushing 66 is preferably manufacture of a friction reducing material such as bronze or the like. The bushing 66 is located between the radially extending flange 54 and the end of the sleeve 48 and wall 50A" to reduce friction therebetween. Moreover, the bushing 66 rather than the radially extending flange 54, absorbs wear caused by the axial thrust. Longevity of the shaft release coupling 42 is thereby improved.

Figure 4B:
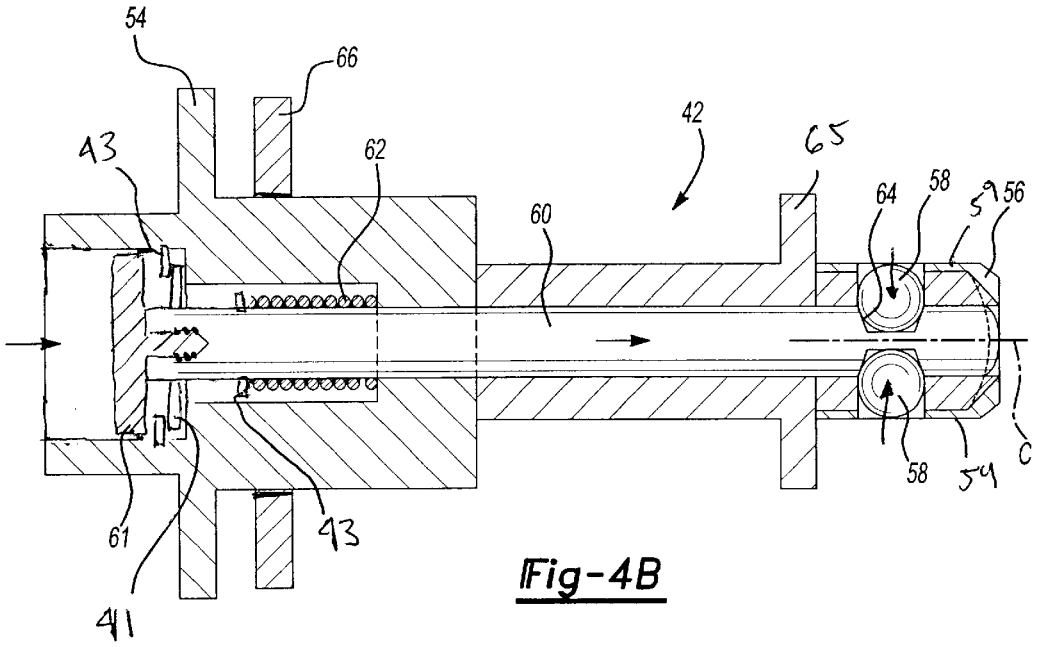
FIG. 4B is an expanded partial phantom view of the shaft release coupling in an unlocked condition.

To mount the drum 14, the drum shaft 32 is located in the sleeve 48. Once the shaft 32 is accessible on the opposite side of the sleeve 48, the release 60 is pressed inwardly (opposite arrow L) to overcome the biasing member 62. Preferably an annular stop 41 such as a washer is mounted along the release 60 by fasteners 43 such as internal and external lock washers to limit axial travel of the release 60 and an actuator button 61. By locating the stop 41 within the shaft release coupling 42, access to the actuator button 61 is increased. The release 60 and the cam surfaces 64 are retracted allowing the retractable engagement member 58 to retract into the shaft release coupling 42 (FIG. 4B). The polygonal shaped distal end 56 is then located in the polygonal opening 40 (FIG. 3.) Once the retractable engagement member 58 reaches the recess 46 in the face 44, the biasing member 62, through interaction with the cam surfaces 64, drives the retractable engagement member 58 into the recess 46. The drum 14 is thereby rotatably locked in place.

Importantly, the interface between the polygonal shaped distal end 56 and polygonal opening 40 allows the rotational forces to be placed upon the corresponding faces 44 and 59. Interaction between the engagement member 58 and the recess 46 resist the axial thrust along axis A. Separation of these forces provides a secure, yet easily removable engagement.

To remove the drum 14, the release 60 is pressed inwardly (FIG. 4B) and the shaft release coupling 42 is removed from the shaft 32. The shaft 32 is then slid out of the sleeve 48 to remove the drum 14.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. In a drain cleaning machine having a rotary drum, a drum release assembly comprising:

a rotary drum shaft extending from the drum and defining an axis of rotation, said rotary drum shaft having a polygonal opening defined along said axis of rotation;

a sleeve to rotatably receive said rotary drum shaft; and a shaft release coupling removably engageable with said polygonal opening, said shaft release coupling having a radially extending flange engageable with an end of said sleeve.

2. The drum release assembly as recited in claim 1, further comprising a thrust washer adjacent said flange.

3. The drum release assembly as recited in claim 1, wherein said polygonal opening includes a hemispherical recess in a face of said polygonal opening.

4. The drum release assembly as recited in claim 1, wherein said polygonal opening includes a square-shaped opening having a recess in a face of said square-shaped opening.

5. The drum release assembly as recited in claim 1, wherein said shaft release coupling telescopically engages said polygonal opening.

6. The drum release assembly as recited in claim 1, wherein said shaft release coupling includes an engagement member engageable with a hemispherical recess in a face of said polygonal opening.

7. The drum release assembly as recited in claim 6, wherein said shaft release coupling includes a release to release said engagement member from within said hemispherical recess.

8. The drum release assembly as recited in claim 7, further comprising a biasing member to bias said release to a locked position.

9. In a drain cleaning machine having a rotary drum, a drum release assembly comprising:

a rotary drum shaft extending from the drum and defining an axis of rotation, said rotary drum shaft having a square-shaped opening defined along said axis of rotation;

a sleeve to rotatably receive said rotary drum shaft; and a shaft release coupling having a square shaped distal end telescopically engageable with said square-shaped opening, said shaft release coupling having a radially extending flange engageable with an end of said sleeve.

10. The drum release assembly as recited in claim 9, further comprising a thrust washer between said flange and said end of said sleeve.

11. The drum release assembly as recited in claim 9, wherein said square-shaped opening includes a hemispherical recess in each face of said square-shaped opening.

12. The drum release assembly as recited in claim 11, wherein said shaft release coupling includes an engagement member engageable with said hemispherical recess.

13. The drum release assembly as recited in claim 12, wherein said shaft release coupling includes a release to release said engagement member from within said hemispherical recess.

14. The drum release assembly as recited in claim 13, further comprising a biasing member to bias said release to a locked position.

15. A drain cleaning machine comprising:

a support frame;

a removable rotary drum;

a rotary drum shaft extending from said removable rotary drum, said rotary drum shaft having a polygonal opening defined along said axis of rotation;

a drive assembly to rotate said removable rotary drum about said axis of rotation;

a sleeve to rotatably receive said rotary drum shaft;

a shaft release coupling removably engageable with said polygonal opening, said shaft release coupling having a radially extending flange engageable with said support frame.

16. The drain cleaning machine as recited in claim 15, further comprising a thrust washer between said flange and an end of said sleeve.

17. The drain cleaning machine as recited in claim 15, wherein said shaft release coupling is at least partially recessed into said support frame.

18. The drain cleaning machine as recited in claim 15, wherein said polygonal opening includes a square-shaped opening having a hemispherical recess in a face of said square-shaped opening.

* * * * *